US006763644B1

(12) United States Patent
Toledo

(10) Patent No.: US 6,763,644 B1
(45) Date of Patent: Jul. 20, 2004

(54) CONSTRUCTION BLOCK SYSTEM

(76) Inventor: Omar Toledo, 6940 Bamboo St., Miami Lakes, FL (US) 33014

( * ) Notice: Subject to any disclaimer, the term of this patent is extended or adjusted under 35 U.S.C. 154(b) by 0 days.

(21) Appl. No.: 10/349,250

(22) Filed: Jan. 23, 2003

(51) Int. Cl.[7] ..... E04B 2/00; E04C 1/00
(52) U.S. Cl. ..... 52/592.6; 52/604
(58) Field of Search ..... 52/591.1, 592.3, 52/592.1, 561, 562, 604, 605, 612, 745.1, 749.14, 749.13, 592.6

(56) References Cited

U.S. PATENT DOCUMENTS

| | | | | | |
|---|---|---|---|---|---|
| 900,753 | A | | 10/1908 | Mahler | 52/605 |
| 3,905,170 | A | * | 9/1975 | Huettemann | 52/591.1 |
| 4,627,209 | A | * | 12/1986 | Schwartz | 52/591.1 |
| 4,956,958 | A | | 9/1990 | Caroti | 52/605 |
| 5,457,926 | A | * | 10/1995 | Jensen | 52/604 |
| 5,802,797 | A | * | 9/1998 | Storer-Folt | 52/604 |
| 5,809,720 | A | * | 9/1998 | Sauve | 52/302.4 |
| 6,082,067 | A | | 7/2000 | Bott | 52/592.3 |
| 6,138,426 | A | * | 10/2000 | Mork et al. | 52/562 |
| 6,170,221 | B1 | * | 1/2001 | Behunin | 52/745.1 |
| 6,226,951 | B1 | * | 5/2001 | Azar | 52/604 |
| 6,434,813 | B1 | * | 8/2002 | Grabmeier | 29/559 |

* cited by examiner

*Primary Examiner*—Leslie A. Braun
*Assistant Examiner*—Tan Le
(74) *Attorney, Agent, or Firm*—J. Sanchelima; A. Bordas

(57) ABSTRACT

A block system that includes a block with slanted walls on its edges forming longitudinal grooves to receive cement without introducing separations or spaces between abutting blocks. A base alignment tool is used to guide the blocks of the first row to ensure proper alignment. The base alignment includes a longitudinal extending sheet with spaced apart lateral walls for receiving the blocks inbetween. A row leveling tool is used to keep in alignment two blocks in different contiguous rows and separated. An elongated rigid member interconnects two bracing members attached to separated blocks in contiguous row.

12 Claims, 4 Drawing Sheets

CONSTRUCTION BLOCK SYSTEM

BACKGROUND OF THE INVENTION

1. Field of the Invention

The present invention relates to a construction block and accessories, and more particularly, to a construction block system that can be readily aligned during installation with predictable dimensions for the resulting structure.

2. Description of the Related Art

Many designs for construction blocks have been designed in the past. None of them, however, includes external longitudinal slanted walls extending horizontally and vertically that avoid the creation of spaces between abutting blocks yet provide grooves or spaces for receiving cement. The conventional block is separated by the cement that is typically used between blocks. And these separations are also responsible for unpredictable overall dimensions of the resulting wall structures. These separations add up and result in misalignment.

Once the invention's blocks are abuttingly positioned, they form a wall. The user incorporates the cementitious compound to the grooves without any additional adjustment.

Applicant believes that a related reference corresponds to U.S. Pat. No. 900,753 issued to A. G. Mahler on Oct. 13, 1908 for a building block. Mahler's block includes end walls with vertically disposed ribs and bosses with tapered side edges on one of the horizontal faces. The outer faces of the ribs form a bonding space between ribs and bosses to receive concrete to bond adjacent horizontal rows. The end walls between ribs and bosses are flat and depressed. However, separations are still formed between abutting blocks.

Applicant believes that another related reference corresponds to U.S. Pat. No. 6,082,067 issued to Tim Allen Bott on Jul. 4, 2000 for dry stackable block structures. Bott's stackable block structure system for dry stacking concrete reinforced walls, includes a stretcher block with a recess of triangular cross-section on the bottom surface and disposed intermediate a pair of co-planar, parallelly disposed laterally extending rectangular edge portions. The top surface of the block includes a flat portion in the center and two edge portions forming upwardly converging surfaces of truncated triangular cross-section. Again, separations occur between abutting blocks when cement is applied.

Applicant believes that another reference corresponds to U.S. Pat. No. 4,956,958 issued to Gine P. N. Caroti on Sep. 18, 1990 for autofitting building blocks and bricks. Caroti's building block has a plurality of dihedral projections on the top surface, which mate with a plurality of dihedral recessions on the bottom surface. The bottom surface includes one more recession than the top surface so that a channel is formed between two stacked bricks. Caroti places the grooves in the end walls to form vertical channels. The separations between abutting blocks are also created when cement is applied.

These patented blocks differ from the present invention because they do not include external horizontal edge cutouts to receive the cement. This avoids the creation of separations between abutting blocks that contribute to misalignment while still receiving an effective amount of cement in the grooves to keep the blocks together. Also, the present invention includes the use of block accessories, such as the base alignment tool and row leveling tool, that permit a user to keep a wall structure aligned throughout its construction. These features are not suggested in these references.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a construction block system that allows a user to align and level contiguous blocks without separation in-between to form wall structures.

It is another object of this invention to provide a block that includes external longitudinal edge cutouts for receiving cement without creating a separation between abutting blocks.

It is still another object of this invention to provide a block system that allow a user to readily build wall structures with a consequent saving of time.

It is still another object of this invention to provide a block system that can be readily assembled and disassembled without requiring specialized tools or substantial previous training or experience.

It is yet another object of this invention to provide such a block system that is inexpensive to manufacture and use and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
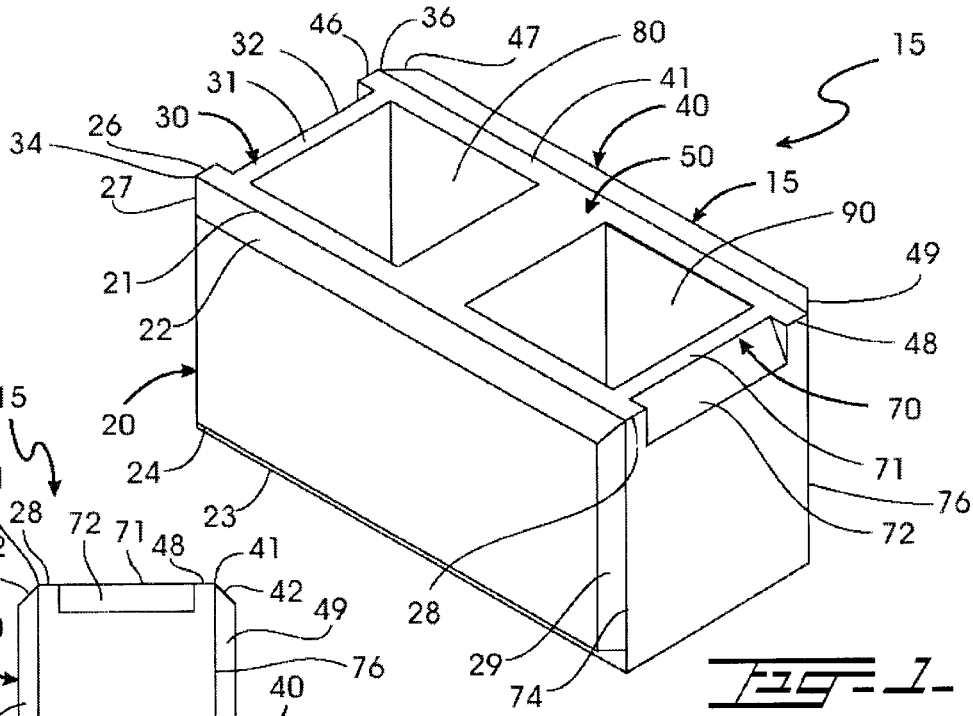
FIG. 1 represents an isometric view of one of the preferred embodiments for the construction block, used in the system object of the present invention.

Referring now to the drawings, where the present invention is generally referred to with numeral 10, it can be observed that it basically includes block 15, base alignment tool assembly 100, a row leveling tool assembly 200 and block 315.

Block 15 includes longitudinal walls 20 and 40 and transversal walls 30, 50 and 70. Longitudinal walls 20 and 40 are disposed at a parallel and spaced apart relationship with respect to each other and perpendicularly with respect to transversal walls 30, 50 and 70. The disposition of walls 20 and 40, 30, 50 and 70 defines internal cavities 80 (between walls 30 and 50) and 90 (between walls 50 and 70).

Block 15 has upper edges 21 and 41 of longitudinal walls 20 and 40, respectively, that terminate with upper slanted walls 22 and 42. Block 15 also has corner portions 26 and 28 for wall 20 and corners portions 46 and 48 for wall 40. Walls 20 and 40 also include side edges 34 and 74, for wall 20, and side edges 36 and 76, for wall 40, that extend perpendicularly from edges 21 and 23; 41 and 43, respectively. Side edges 34; 36; 74 and 76 include side edge slanted walls 27; 29; 47 and 49. Side edge slanted walls 27 and 29 (for wall 20) extend vertically adjacent to corner portions 26 and 28, respectively. In the same way, side edge slanted walls 47 and 49 (for wall 40) extend vertically adjacent to corner portions 46 and 48. Side edge slanted walls 27, 29, 47 and 49, form vertical grooves when abutting blocks 15 are positioned in the same row to receive the cementitious substance typically used to keep blocks together.

Figure 1A:
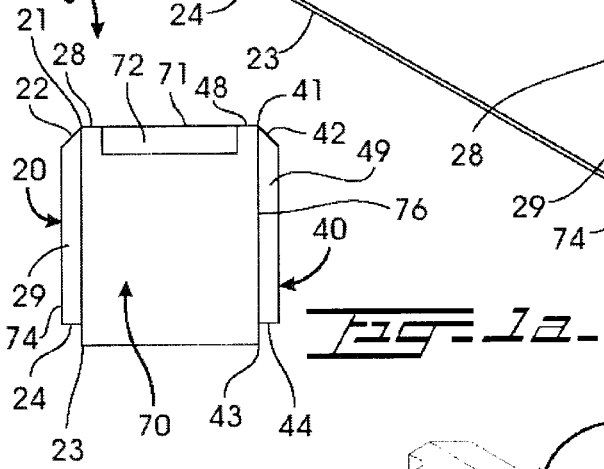
FIG. 1*a* is an end elevational view of the embodiment represented in FIG. 1 for the construction block.
Figure 2:
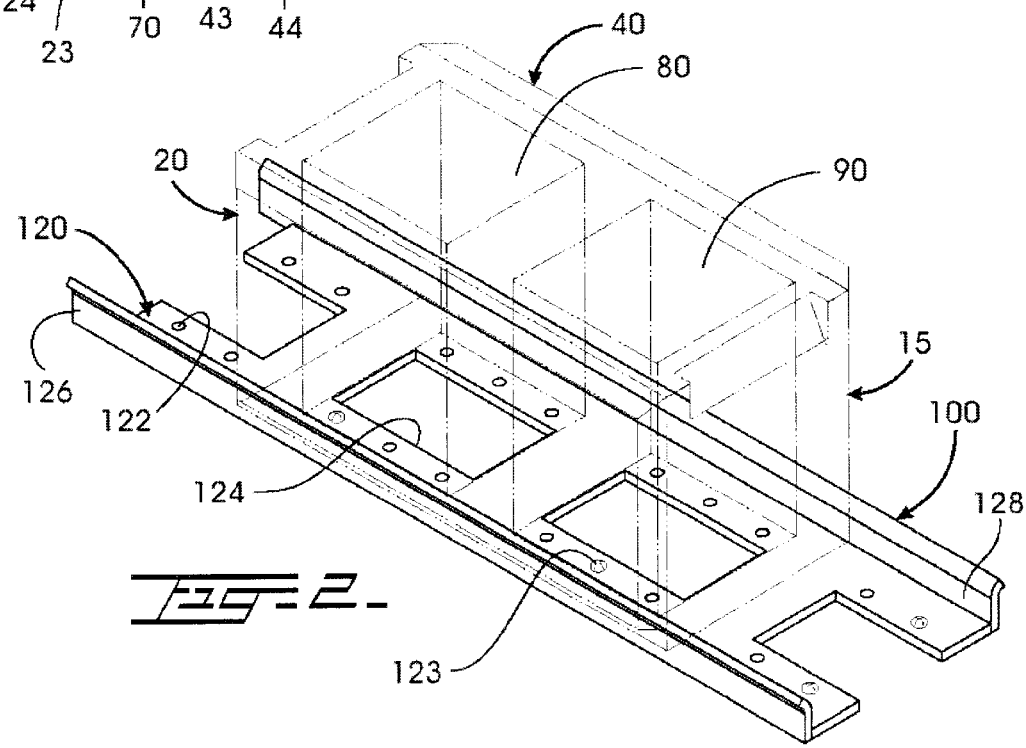
FIG. 2 shows an isometric view of the base alignment assembly used in the construction block system, including a block (shown in phantom) cooperatively positioned.

Block 15 also includes lower edges 23 and 43 of longitudinal walls 20 and 40, respectively, that terminate with external longitudinal edge cutouts 24 and 44. In the preferred embodiment, longitudinal edge cutouts 24 and 44 are at a 90-degree angle with respect to walls 20 and 40, respectively, as best seen in FIG. 1*a*. Upper slanted walls 22 and 42 of vertically contiguous blocks form longitudinal grooves that receive the cementitious substance when at least two rows of blocks 15 are completed.

Transversal walls 30 and 70 include upper edges 31 and 71, respectively. Upper edge 31 includes upper slanted external wall 32. Similarly, upper edge 71 includes upper slanted external wall 72. Upper slanted external wall 32 is sandwiched by corner portions 26 and 46. Upper slanted external wall 72 is sandwiched by corner portions 28 and 48. The upper slanted external walls 32 and 72 of contiguous blocks coact with each other and the internal side of corner portions 28 and 48 to define a space for receiving cementitious substances. These corners provide stability and surface to surface abutment for contiguous blocks.

Base alignment tool assembly 100 is a base tool for horizontally aligning the lowermost row of blocks 15. Base alignment tool assembly 100, also permits a user to level the base when the footing has irregularities. Base alignment tool assembly 100 includes longitudinally extending sheet 120 with lateral walls 126 and 128 perpendicularly mounted to sheet 120. Walls 126 and 128 are at a parallel and spaced apart relationship with respect to each other. Sheet 120 has a cooperative width to receive lower edges 23 and 43 of walls 20 and 40 between lateral walls 126 and 128. Lateral walls 126 and 128 have substantially outwardly terminations to facilitate the entrance of lower edges 23 and 43 thereinto. Sheet 120 includes through openings 122, in the preferred embodiment, disposed along the entire length of sheet 120 and through openings 124 with the substantially same shape and dimensions of cavities 80 and 90, leaving a small clearance for openings 122. Through openings 122 cooperatively and selectively receive screw members 123 or similar members (such as nails or other fastening members used in the art). Screw members 123 cooperatively anchor base alignment tool assembly 100 to the footing and also level base alignment tool assembly 100 when horizontal alignment is required.

Figure 3:
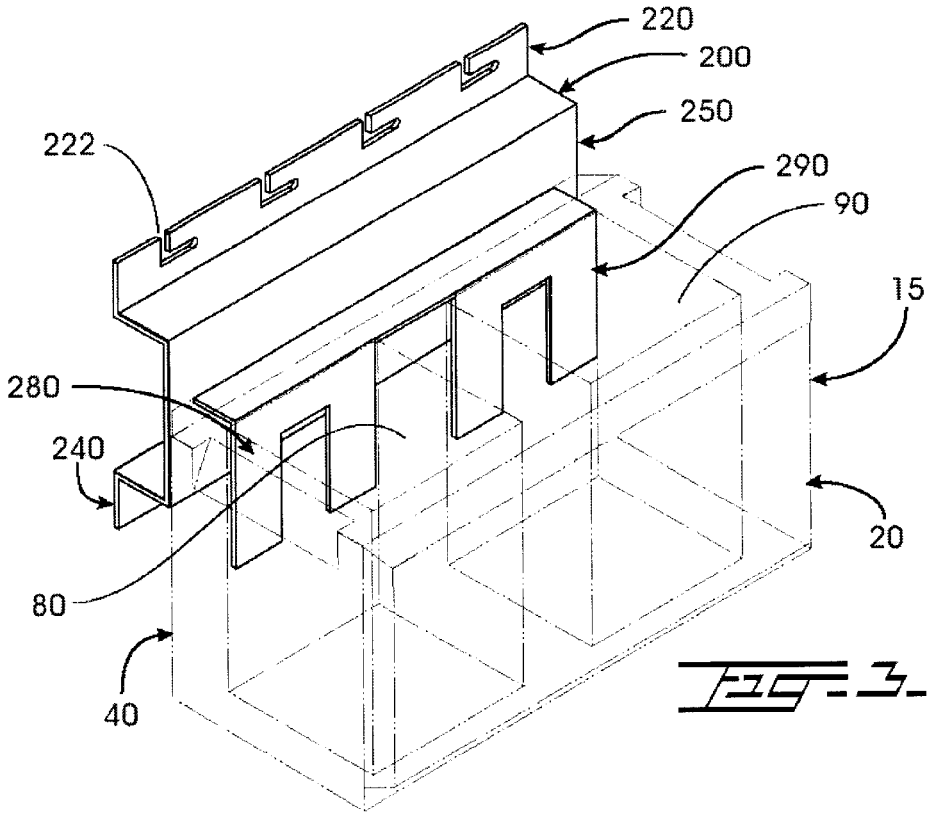
FIG. 3 illustrates a rear isometric view of the row alignment tool used in the construction block system, mounted to a block (shown in phantom).
Figure 4A:
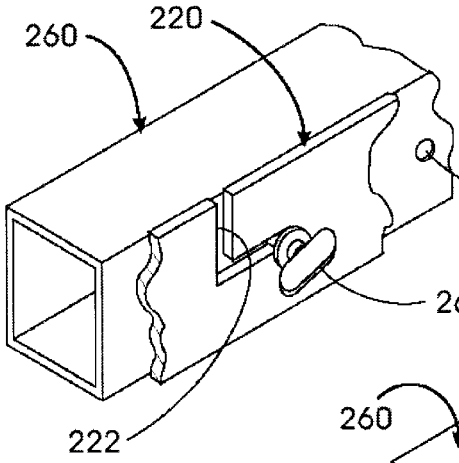
FIG. 4*a* is an enlarged view of the engaging mechanism used in row alignment assembly taken from FIG. 4.
Figure 4:
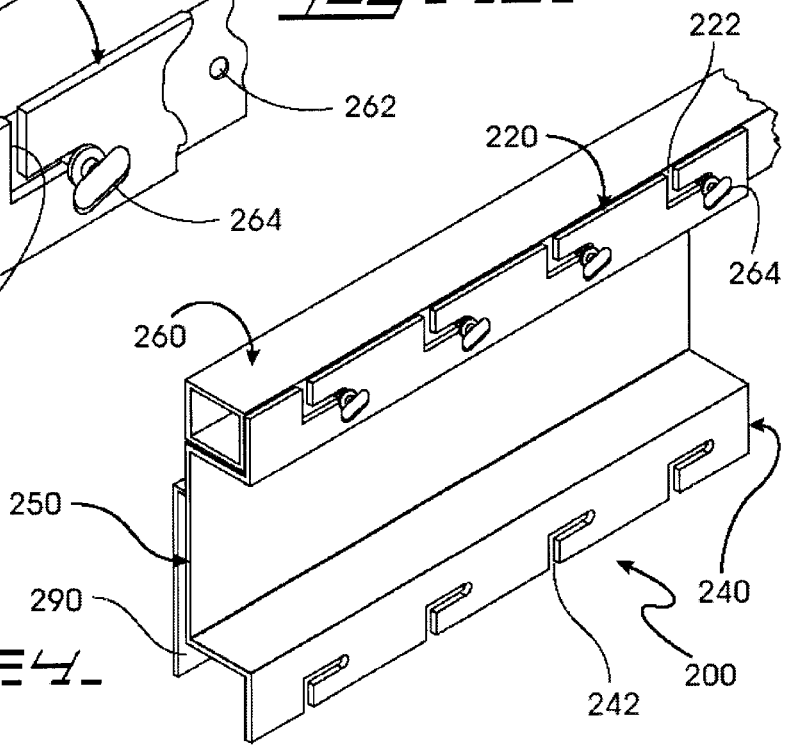
FIG. 4 illustrates a front isometric view of the row alignment assembly used in the construction block system.
Figures 5A, 5B, 6:
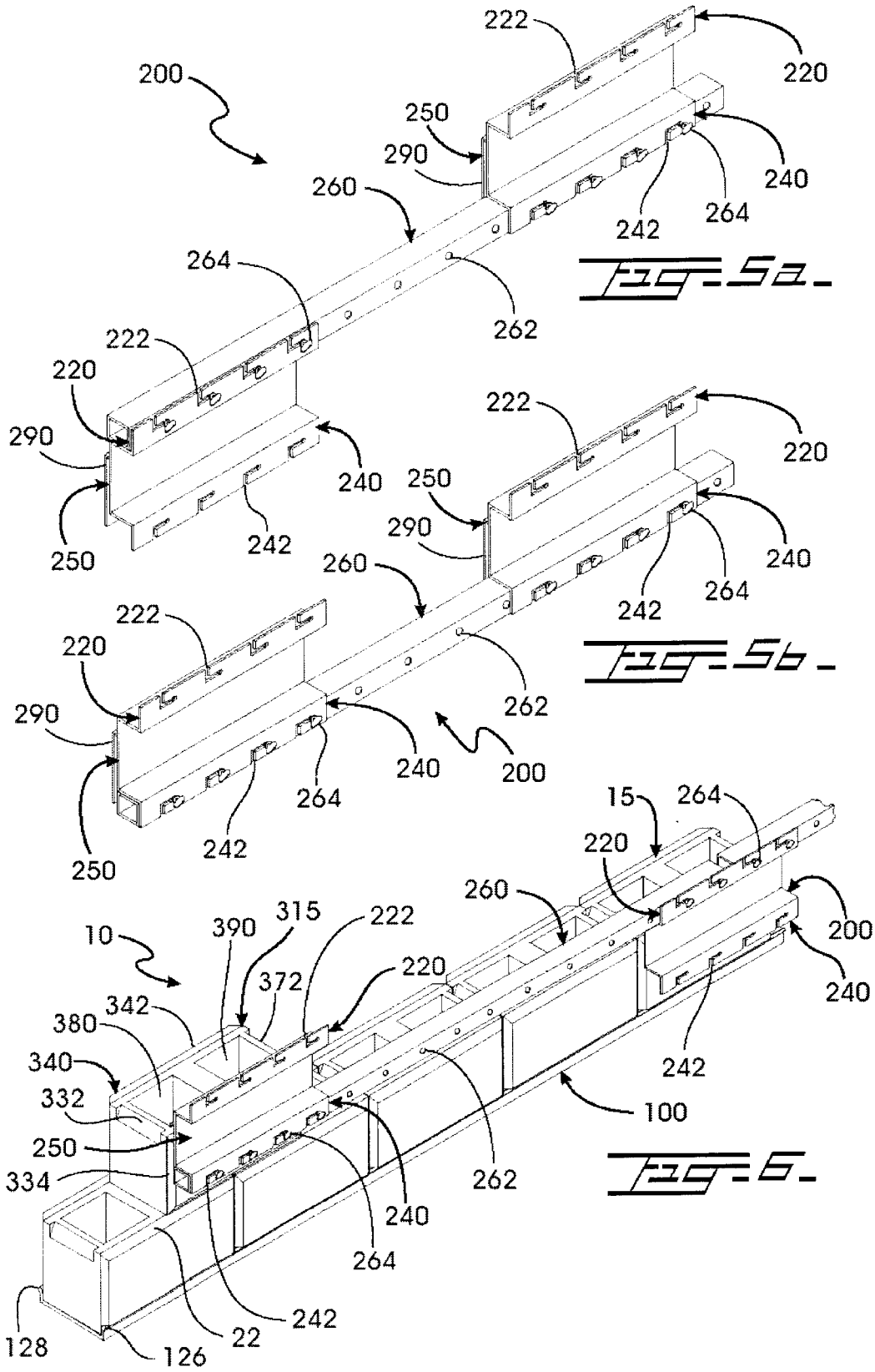
FIG. 5*a* is an isometric view of the row alignment assembly used in the construction block system, where two alignment members are positioned in different contiguous rows.
FIG. 5*b* is an isometric view of the row alignment assembly used in the present construction block system, where the alignment members are positioned in the same row.
FIG. 6 shows an isometric view of a wall structure being built using the present invention when the blocks are placed over the base alignment assembly, the final cementitious compound has not been applied yet and the row leveling assembly is mounted in two contiguous rows.
Figure 7:
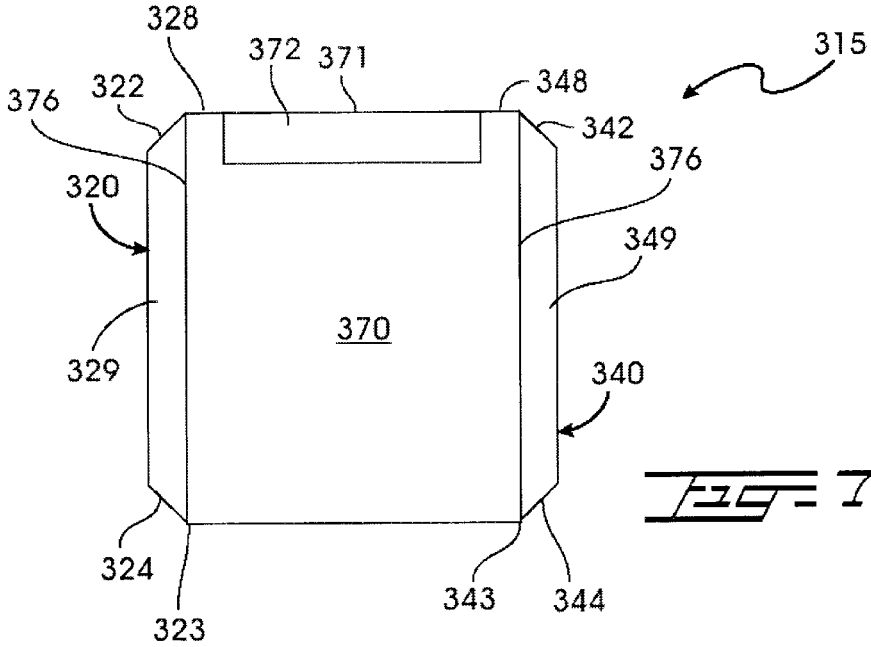
FIG. 7 is an end elevational view of the embodiment for the construction block used for rows other than base row.
Figure 8:
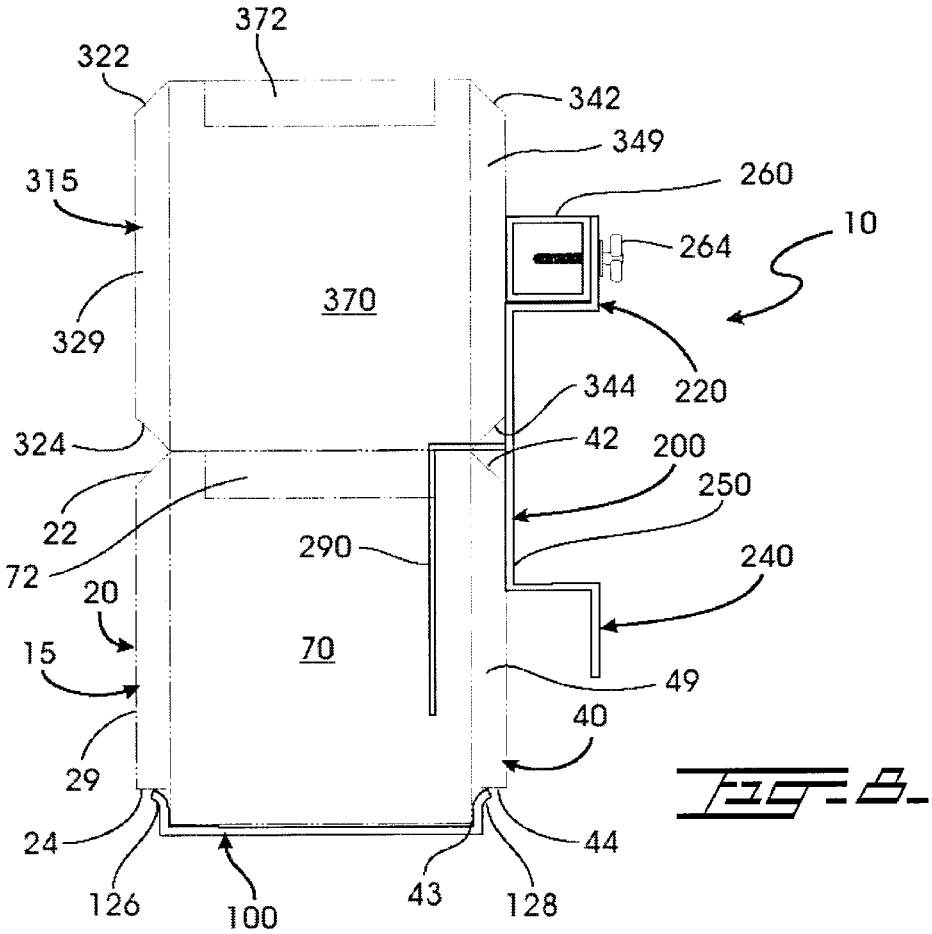
FIG. 8 is an end elevational view of the construction block system including two contiguous abutting block rows, base alignment tool assembly and row leveling tool assembly mounted thereto.

Row leveling tool assembly 200 is removably mounted to cavities 80 and 90 of block 15, to facilitate the vertical and horizontal alignment of the rows, as shown in FIGS. 3 and 4. Row leveling tool assembly 200 includes bracing members 220 and 240, which are mounted to blocks 15 in contiguous rows and hook members 280 and 290 that are removably mounted to cavities 80 and 90. Row leveling tool assembly 200 also includes support member 250 and a straight elongated rigid members 260 with cooperative dimensions to be received by bracing members 220 and 240. In this manner, blocks 15 in contiguous rows, and those in between, are kept in alignment, as seen in FIGS. 5*a* and 5*b*. Straight elongated rigid member 260 includes a plurality of openings 262 that receive fastening members 264 therethrough. Additionally, bracing members 220 and 240 includes L-shaped openings 222 and 242 to cooperatively and slidably receive fastening members 264, mounted straight elongated rigid member 260, as best seen in FIG. 4*a*. Once a user mounts straight elongated rigid member 260 to bracing members 220 and/or 240, he/she aligns it with tool assembly 200 by adjusting fastening members 264.

Block 315 is intended to be used in rows other than the base (first laid) row. Block 315 has substantially the same shape and dimensions of block 15, as shown in FIGS. 6; 7 and 8, with longitudinal walls 320 and 340 and transversal walls 330, 350 and 370, defining internal cavities 380 (between walls 330 and 350) and 390 (between walls 350 and 370). Block 315 has upper edges 321 and 341 of longitudinal walls 320 and 340, respectively, that terminate with upper slanted walls 322 and 342. Block 315 also has corner portions 326 and 328 for wall 320 and corners portions 346 and 348 for wall 340. Walls 320 and 340 also include side edges 334 and 374, for wall 320, and side edges 336 and 376, for wall 340, that extend perpendicularly from edges 321 and 323; 341 and 343 respectively. Side edges 334; 336; 374 and 376 include side edge slanted walls 327; 329; 347 and 349. Side edge slanted walls 327 and 329 (for wall 320) extend vertically adjacent to corner portions 326 and 328, respectively. In the same way, side edge slanted walls 347 and 349 (for wall 340) extend vertically adjacent to corner portions 346 and 348. Walls 327, 329, 347 and 349, forming vertical grooves when abutting blocks 315 are positioned in the same row to receive a cementitious substance typically used to keep blocks together. Furthermore, block 315 also includes lower edges 323 and 343 of longitudinal walls 320 and 340, respectively, that terminate with lower slanted walls 324 and 344.

Transversal walls 330 and 370 include upper edges 331 and 371, respectively. Upper edge 331 includes upper slanted external wall 332. Similarly, upper edge 371 includes upper slanted external wall 372. Upper slanted external wall 332 is sandwiched by corner portions 326 and 346. Upper slanted external wall 372 is sandwiched by corner portions 328 and 348.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A construction block system including a block comprising:

A) first and second walls kept at a parallel and spaced apart relationship with respect to each other and including first and second, upper and lower edges, said first and second upper edges including first and second upper slanted walls, and each of said first and second walls further including first and second side edges that extend perpendicularly from said first and second, upper and lower edges, and said first and second side edges include first and second side edge slanted walls and said first and second lower edges including first and second longitudinal square cutouts; and B) third and fourth walls kept at a parallel and spaced apart relationship with respect to each other and connected to said first and second walls to form a block with a substantially rectangular cross-section, and including third and fourth upper edges, said third and fourth upper edges including third and fourth upper slanted external walls, said third and fourth walls being perpendicularly mounted to said first and second walls and said third and fourth upper slanted external walls cooperate to form grooves with contiguous blocks in a wall structure and said grooves cooperate to receive an effective amount of a cementitious substance without creating any space between abutting blocks.

2. The block system set fourth is claim 1 further including:

C) a fifth wall perpendicularly mounted between said first and second walls at predetermined distances from said third and fourth walls defining first and second internal cavities.

3. The block system set forth in claim 2 further comprising:

D) a base alignment tool assembly including a longitudinally extending sheet having a cooperative width to receive said first and second lower edges, said sheet including a plurality of through openings disposed along the entire length of said sheet, said base alignment tool assembly further including first and second lateral walls perpendicularly mounted to said sheet at predetermined distances for receiving said first and second lower edges of said first and second walls of the lowermost row of a wall structure to keep said blocks in alignment.

4. The block system set forth in claims 3 wherein said sheet includes means for leveling said sheet with a horizontal plane.

5. The block system set forth is claim 4 further including:

E) a row leveling tool assembly including first and second bracing members mounted on separated blocks in contiguous rows, said row leveling tool assembly further including hook means for holding themselves from said first upper edge, and said row leveling tool assembly further including first support means mounted to said first and second bracing members, and at least one straight elongated rigid member receivable by said first and second bracing members so that said separated blocks in contiguous rows, and those in between, are kept in alignment.

6. The block system set forth is claim 5 further including:

F) fastening means for removably keeping said rigid member secured to said first and second bracing members.

7. The block system set forth is claim 6 wherein said third and fourth walls include corner portions that coact with contiguous horizontally disposed blocks to provide a surface for abutting alignment while said third and fourth upper slanted external walls, disposed inbetween said third and fourth corner portions defining a space for a cementitious substance.

8. A construction block system including a block comprising:

A) first and second walls kept at a parallel and spaced apart relationship with respect to each other and including first and second upper edges as well as first and second lower edges, said first and second, upper and lower edges including first and second, upper and lower slanted walls, and each of said first and second walls further including first and second side edges that extend perpendicularly from said first and second, upper and lower edges, and said first and second side edges include first and second side edge slanted walls; and B) third and fourth walls kept at a parallel and spaced apart relationship with respect to each other and connected to said first and second walls form a block with a substantially rectangular cross-section, and including third and fourth upper edges, said third and fourth upper edges including third and fourth, upper slanted external walls, said third and fourth walls being perpendicularly mounted to said first and second walls, and said third and fourth upper slanted external walls cooperate to form grooves with contiguous blocks in a wall structure and said grooves cooperate to receive an effective amount of a cementitious substance without creating any space between abutting blocks.

9. The block system set fourth is claim 8 further including:

C) a fifth wall perpendicularly mounted between said first and second walls at predetermined distances from said third and fourth walls defining first and second internal cavities.

10. The block system set forth is claim 9 further including:

E) a row leveling tool assembly including first and second bracing members mounted on separated blocks in contiguous rows, said row leveling tool assembly further including hook means for holding themselves from said first upper edge, and said row leveling tool assembly further including first support means mounted to said first and second bracing members, and at least one straight elongated rigid member receivable by said first and second bracing members so that said separated blocks in contiguous rows, and those in between, are kept in alignment.

11. The block system set forth is claim 10 further including:

F) fastening means for removably keeping said rigid member secured to said first and second bracing members.

12. The block system set forth is claim 11 wherein said third and fourth walls include corner portions that coact with contiguous horizontally disposed blocks to provide a surface for abutting alignment while said third and fourth upper slanted external walls, disposed inbetween said third and fourth corner portions defining a space for a cementitious substance.

* * * * *